US011588273B2

(12) United States Patent
Hu

(10) Patent No.: US 11,588,273 B2
(45) Date of Patent: Feb. 21, 2023

(54) CONNECTING-FIXING STRUCTURE FOR A POWER CORD AND HAIR TREATMENT APPLIANCE

(71) Applicant: Dongguan Fumeikang Electrical Technology Co., LTD., Guangdong (CN)

(72) Inventor: Haowen Hu, Guangdong (CN)

(73) Assignee: DONGGUAN FUMEIKANG ELECTRICAL TECHNOLOGY CO., LTD., Dongguan (CN)

( * ) Notice: Subject to any disclaimer, the term of this patent is extended or adjusted under 35 U.S.C. 154(b) by 73 days.

(21) Appl. No.: 17/347,835

(22) Filed: Jun. 15, 2021

(65) Prior Publication Data

US 2021/0313738 A1 Oct. 7, 2021

(30) Foreign Application Priority Data

Dec. 9, 2020 (CN) ..... 202022934700.1

(51) Int. Cl.
*H01R 13/625* (2006.01)
*H01R 13/639* (2006.01)

(52) U.S. Cl.
CPC ..... *H01R 13/625* (2013.01); *H01R 13/639* (2013.01)

(58) Field of Classification Search
CPC ..... H01R 13/625; H01R 13/639
See application file for complete search history.

(56) References Cited

U.S. PATENT DOCUMENTS 3,095,523 A * 6/1963 Stith ..... H05F 3/02 361/220
3,751,579 A * 8/1973 Nojiri ..... F16L 5/00 174/650
3,843,224 A * 10/1974 Gerke, Jr. ..... H01H 1/5866 D13/139.7
3,950,052 A * 4/1976 Walter ..... H01R 39/00 219/533
3,984,168 A * 10/1976 Korman ..... H01R 13/59 439/462
4,017,139 A * 4/1977 Nelson ..... F16L 37/133 439/675
4,082,915 A * 4/1978 Silver ..... H02G 3/0683 174/665

(Continued)

*Primary Examiner* — Neil Abrams
(74) *Attorney, Agent, or Firm* — Shimokaji IP

(57) ABSTRACT

A connecting-fixing structure, used for detachably connecting a main body of an electrical appliance with a power cord, includes a connection end, a locking member, and a rotating sleeve. The locking member includes a supporting shaft and a locking portion which rotates by the supporting shaft as a fulcrum. A locking fitting portion is disposed on the tail end of the power cord and adapted to the locking portion. Furthermore, a rotating sleeve is rotatably sleeved on the connection end, an inner wall of the rotating sleeve has a driving part, and the rotating sleeve rotates to drive the driving part to further drive the locking portion to rotate, thereby locking the locking portion or unlocking the locking portion from the locking fitting portion. The power cord can be disassembled and assembled only by rotating the rotating sleeve, and the operation is convenient, and the structure is simple.

10 Claims, 9 Drawing Sheets

(56) References Cited

U.S. PATENT DOCUMENTS 4,323,725 A * 4/1982 Muller ..... H02G 3/065 439/459
6,043,457 A * 3/2000 Hashimoto ..... A45D 26/0009 132/118
6,149,455 A * 11/2000 Levi ..... H01R 13/59 439/321
6,703,587 B2 * 3/2004 Sena ..... A45D 20/12 132/229
6,752,650 B1 * 6/2004 Lin ..... H01R 13/5825 439/461
6,790,070 B1 * 9/2004 England, II ..... H01R 13/6397 439/372
6,945,805 B1 * 9/2005 Bollinger ..... H01R 39/64 439/348
7,128,598 B2 * 10/2006 Ebert ..... H01R 13/5812 439/495
7,306,483 B2 * 12/2007 Phillips ..... H01R 31/06 439/568
7,318,365 B2 * 1/2008 Huang ..... B25B 13/44 81/128
7,331,813 B2 * 2/2008 Tsujita ..... F16B 21/165 439/348
7,727,003 B2 * 6/2010 Ceroll ..... B25F 5/00 439/456
7,731,516 B2 * 6/2010 Puttinger ..... H01R 4/5008 439/260
8,035,955 B2 * 10/2011 Parks ..... B25F 5/00 361/679.01
8,132,571 B1 * 3/2012 Jackson ..... A45D 7/02 132/211
8,215,962 B1 * 7/2012 Machado ..... H01R 24/58 439/274
9,705,248 B1 * 7/2017 Ko ..... H01R 13/6275
10,340,631 B1 * 7/2019 Hung ..... H01R 13/62927
10,944,195 B1 * 3/2021 Peng ..... H01R 39/64
11,259,612 B2 * 3/2022 Peng ..... H01R 35/04
2021/0313738 A1 * 10/2021 Hu ..... H01R 13/6392

* cited by examiner

2

31

31

CONNECTING-FIXING STRUCTURE FOR A POWER CORD AND HAIR TREATMENT APPLIANCE

RELATED APPLICATIONS

This application claims the benefit of priority to Chinese Utility Model Application No. 202022934700.1 filed on Dec. 9, 2020, which is hereby incorporated by reference in its entirety.

FIELD OF THE INVENTION

The present invention relates to the technical field of connecting and fixing of a power cord and an electric appliance body, more particularly to connecting-fixing structure for a power cord and a main body and a hair treatment appliance.

BACKGROUND OF THE INVENTION

Many electrical appliances, such as curling irons, hair straighteners, hair straightening combs, and electric air combs, are generally equipped with pluggable power cords. After the power cords are inserted into the electrical appliances, the power cords are fixed with the main body of the electrical appliances through a detachable fixing structure to facilitate use and replacement. At present, the power cords on electrical appliances are fixed by buckles, or fixed by screws and fixtures, although these fixing structures can detachably fix the power cords, which are inconvenient to operate and time-consuming to disassemble and assemble the power cords to the electrical appliances.

SUMMARY OF THE INVENTION

One objective of the present invention is to provide a connecting-fixing structure which is convenient for disassembly and assembly a power cord and an electrical appliance.

Another objective of the present invention is to provide a hair treatment appliance which is convenient for disassembly and assembly its power cord.

To achieve the above objective, a connecting-fixing structure, used for detachably connecting a main body of an electrical appliance with a power cord, is provided. The connecting-fixing structure includes a connection end, a locking member, and a rotating sleeve. The connection end is arranged at a tail end of the main body and has a cylindrical structure, and a tail end of the power cord passes through a cavity of the connection end and further plugs into the connection end. The locking member includes a locking piece which is provided with a supporting shaft and a locking portion on one side of the supporting shaft. The locking portion is capable of rotating by the supporting shaft as a fulcrum, and a locking fitting portion is disposed on the tail end of the power cord and adapted to the locking portion. An outer wall of the connection end is opened with an accommodating groove that is communicated with the cavity of the connection end and fits the locking member, and the locking member is mounted in the accommodating groove and pivotally connected to a side wall of the accommodating groove through the supporting shaft. Furthermore, a rotating sleeve is rotatably sleeved on the connection end, an inner wall of the rotating sleeve is provided with a driving part, and the rotating sleeve is rotated to drive the driving part to further drive the locking member to rotate, thereby locking the locking portion or unlocking the locking portion from the locking fitting portion.

Preferably, a bottom surface of the locking piece is an arc-shaped surface, and the curvature of the bottom surface fits an outer wall of the power cord.

Preferably, the bottom surface of the locking piece includes a first end and a second end. The longitudinal distance between the first end and the supporting shaft is greater than the longitudinal distance between the second end and the supporting shaft. The locking portion is disposed at the first end, and the locking fitting portion is an engaging groove capable of engaging with the locking portion.

Preferably, the horizontal distance between the supporting shaft and the first end is greater than the horizontal distance between the supporting shaft and the second end.

Preferably, a top surface of the locking piece is an arc-shaped surface, and the driving part is a protrusion protruding toward the inside of the rotating sleeve. A pressing surface matching the top surface of the locking piece is provided on a side of the driving part away from the inner wall of the rotating sleeve.

Preferably, the distance between one end of the pressing surface facing to the first end and the inner wall of the rotating sleeve is greater than the distance between the other end of the pressing surface and the inner wall of the rotating sleeve.

Preferably, one of the outer wall of the connection end and the inner wall of the rotating sleeve is provided with several sliding grooves, the other of the outer wall of the connection end and the inner wall of the rotating sleeve is provided with a clamping portion corresponding to the sliding grooves, and the clamping portion is rotated along the sliding grooves.

Preferably, a limiting plate for blocking the driving part is respectively disposed on the outer wall of the connection end at both ends of the accommodating groove.

Preferably, two locking members are oppositely provided on the connection end, and two driving parts respectively corresponding to the two locking members are provided on the rotating sleeve.

Furthermore, a hair treatment appliance includes a main body and a power cord. The main body is provided with a connection end for plugging-in the power cord, and the power cord is detachably connected with the main body through the above-mentioned connecting-fixing structure.

In comparison with the prior art, the connecting-fixing structure of the power cord uses the locking member and the rotating sleeve to fix the power cord. The locking member is provided with a supporting shaft and a locking portion capable of rotating with the supporting shaft as a fulcrum. An inner wall of the rotating sleeve is provided with a driving part, and a tail end of the power cord is provided with a locking fitting portion that is adapted to the locking portion. Therefore, by rotating the rotating sleeve, the driving part on the rotating sleeve will drive the locking portion to rotate with the support shaft as the fulcrum, so that the locking portion on the locking member is engaged with or separated from the locking fitting portion on the power cord to lock or unlock the power cord. It can be seen that, by using the connecting-fixing structure of the power cord, the power cord can be disassembled and assembled only by rotating the rotating sleeve, and the operation is convenient and safe, and the structure is simple.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
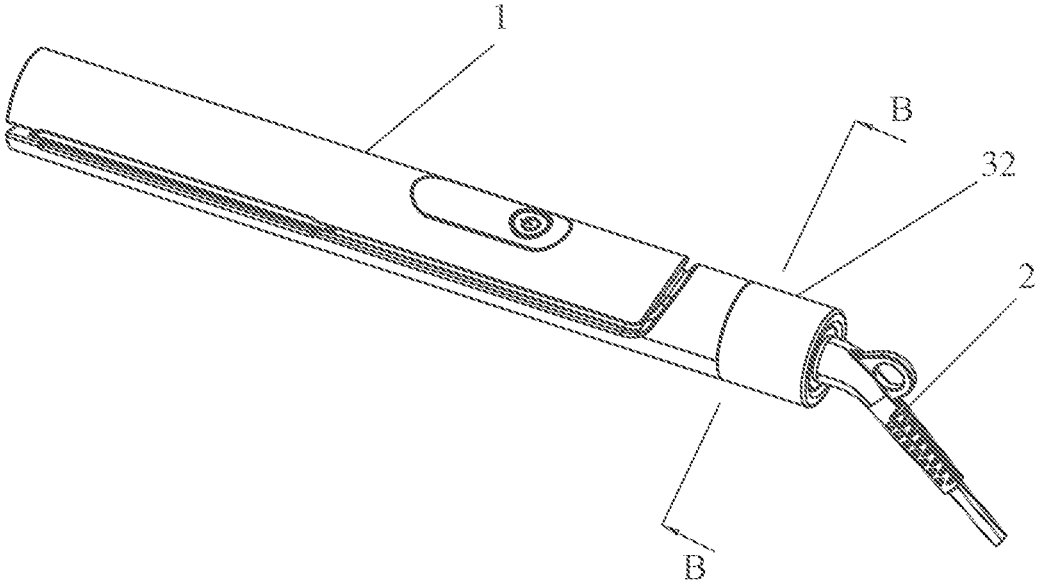
FIG. 1 is a perspective view of a hair treatment appliance according to an embodiment of the present invention.

A distinct and full description of the technical solution of the present invention will follow by combining with the accompanying drawings.

As shown in FIGS. 1 to 6, a hair treatment appliance is provided which includes a main body 1 and a power cord 2. The main body 1 is provided with a connection end 30 for plugging-in the power cord 2. The power cord 2 is detachably connected with the main body 1 through a connecting-fixing structure to disassemble and assemble the power cord 2 easily. Specifically, the hair treatment appliance in this embodiment is described with a hair straightener as an example, but it is not limited to this. The connecting-fixing structure includes a connection end 30, a locking member 31, and a rotating sleeve 32.

Figure 2:
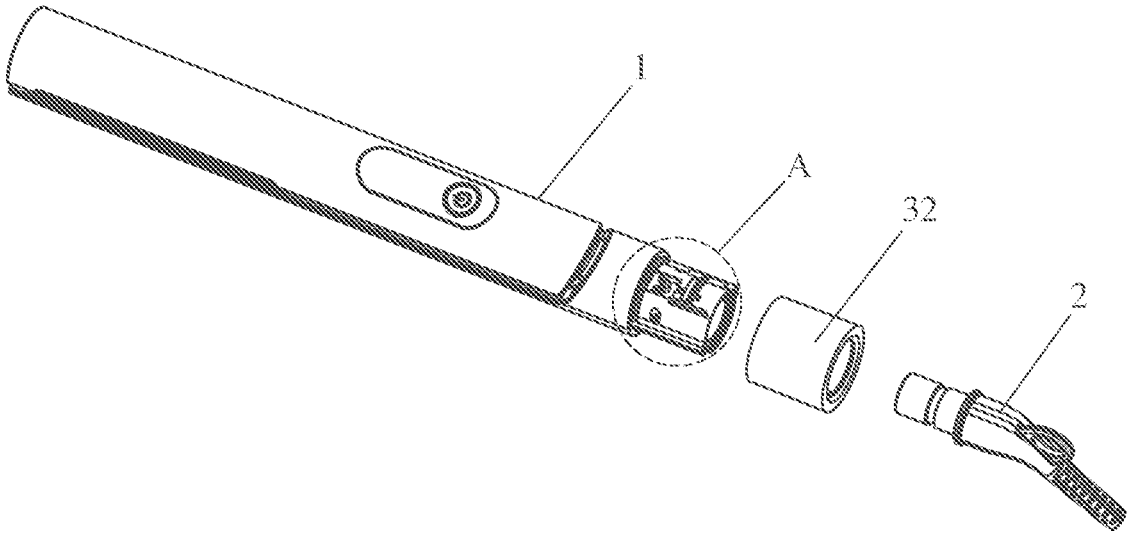
FIG. 2 is an exploded view of FIG. 1.
Figure 3:
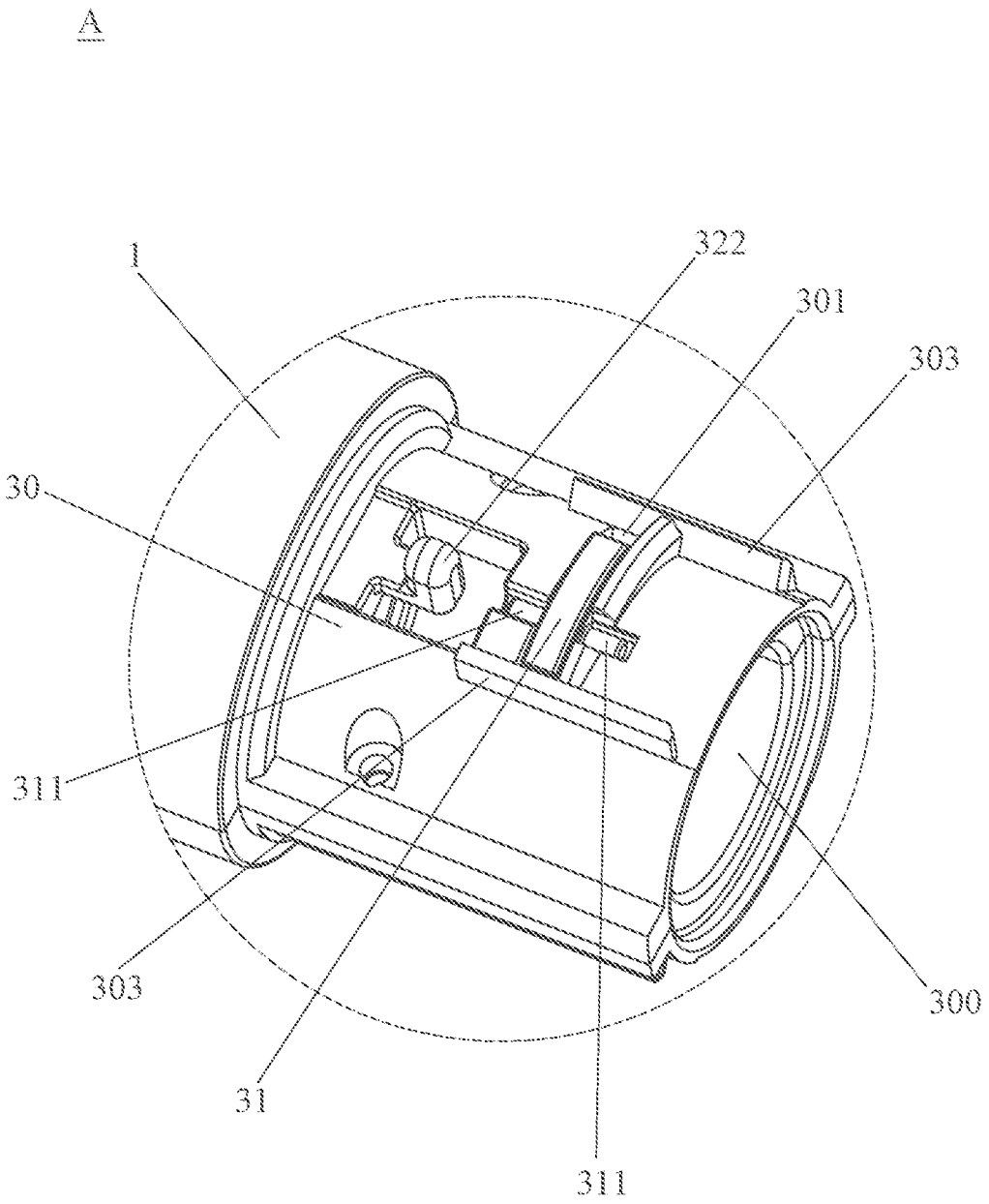
FIG. 3 is an enlarged view of section A in FIG. 2.
Figure 4:
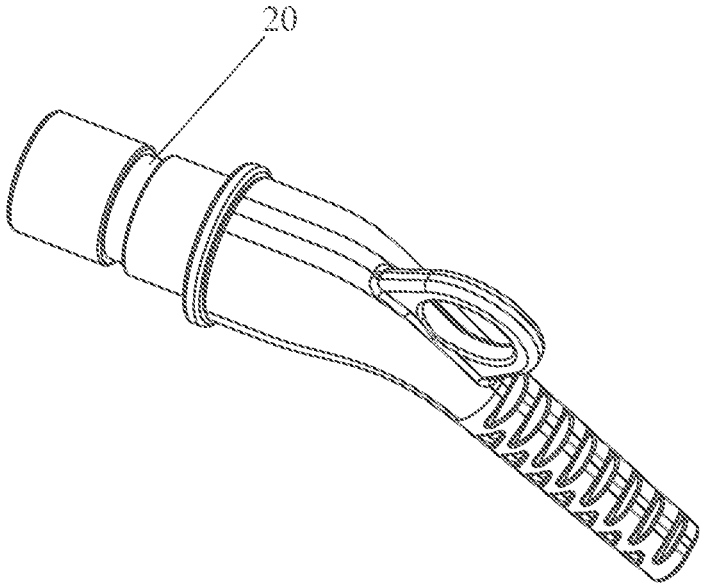
FIG. 4 is an enlarged view of partial structure of a power cord in FIG. 1.
Figure 6:
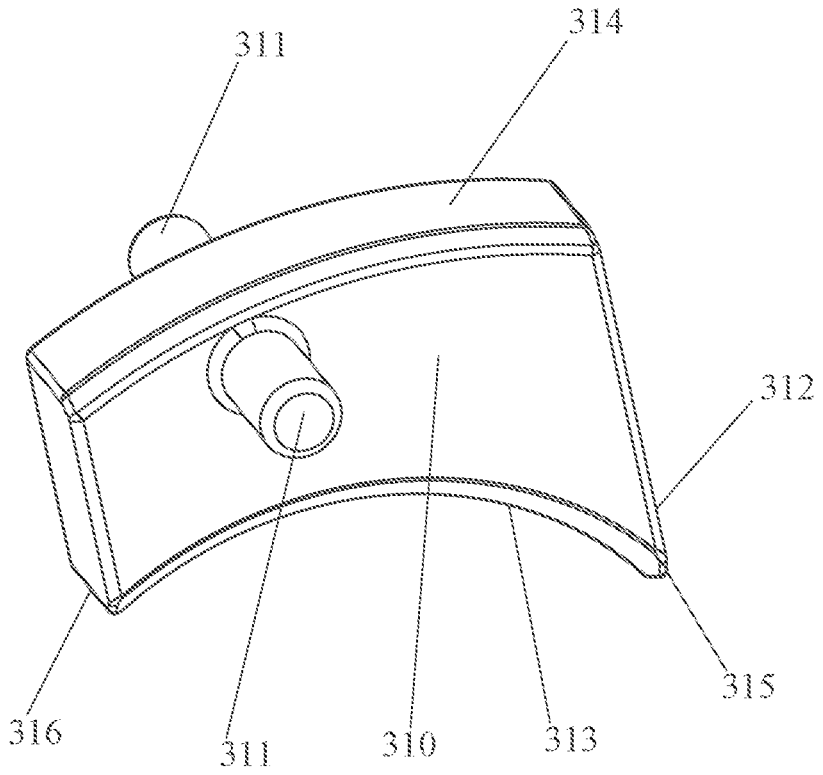
FIG. 6 is a perspective view of a locking member according to an embodiment of the present invention.
Figure 7:
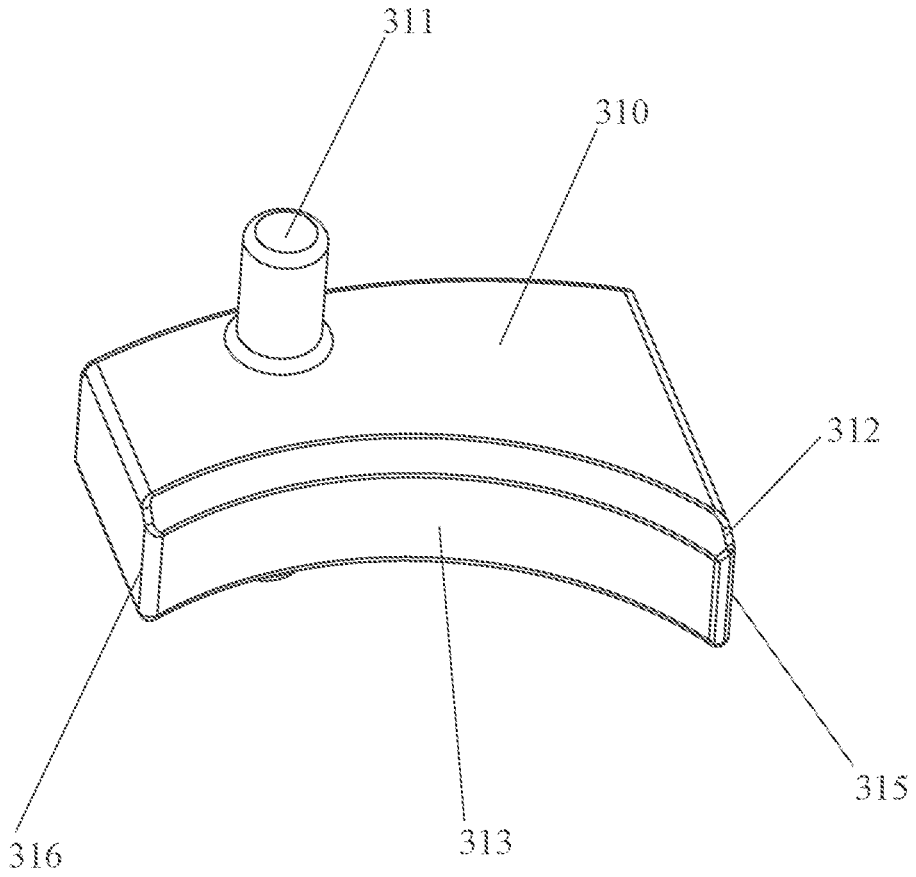
FIG. 7 is a perspective view of the locking member in FIG. 6 viewed from a different angle.

As shown in FIGS. 2 and 3, the connection end 30 is arranged at a tail end of the main body 1 and has a cylindrical structure. In this embodiment, the connection end 30 is integrally formed with the main body 1 of the hair straightener, and a tail end of the power cord 2 can pass through a cavity 300 of the connection end 30 and further plug into the connection end 30 to transmit a power signal to the main body 1 of the hair straightener. As shown in FIGS. 6 and 7, the locking member 31 includes a locking piece 310 which is provided with a supporting shaft 311 and a locking portion 312 on one side of the supporting shaft 311. The locking portion 312 can rotate with the supporting shaft 311 as a fulcrum. As shown in FIG. 4, the tail end of the power cord 2 is provided with a locking fitting portion 20 that is adapted to the locking portion 312. When the locking member 31 is rotated so that the locking portion 312 and the locking fitting portion 20 are engaged together, the power cord 2 is locked; alternatively, when the locking member 31 is rotated to make the locking portion 312 disengage from the locking fitting portion 20, the power cord 2 is unlocked.

As shown in FIG. 3, in order to facilitate the mounting of the locking member 31, an outer wall of the connection end 30 is provided with an accommodating groove 301 that fits the locking member 31 and communicates with the cavity 300 of the connection end 30. The locking member 31 is mounted in the accommodating groove 301 and pivotally connected to a side wall of the accommodating groove 301 through the supporting shaft 311.

Figure 5:
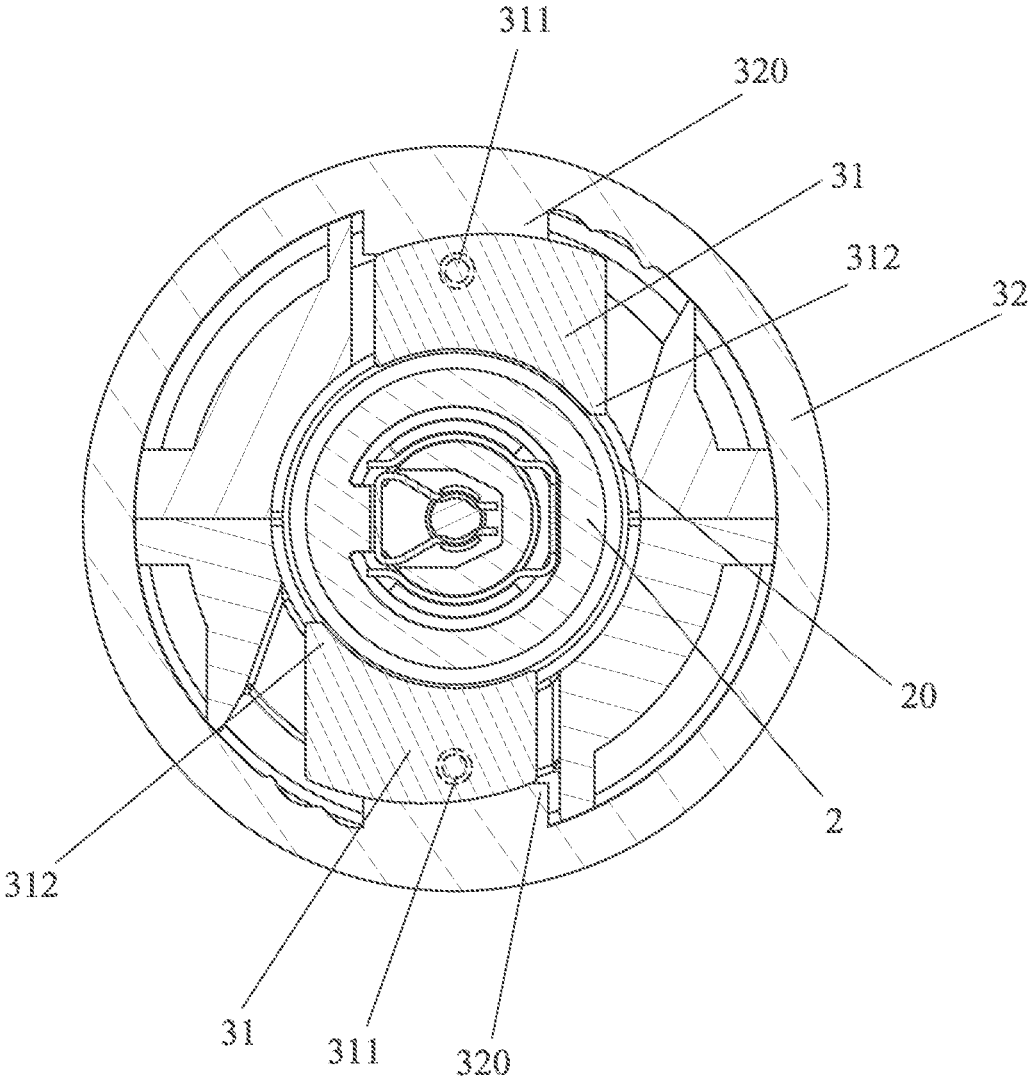
FIG. 5 is a cross-sectional view of FIG. 1 along the line B-B.
Figure 9:
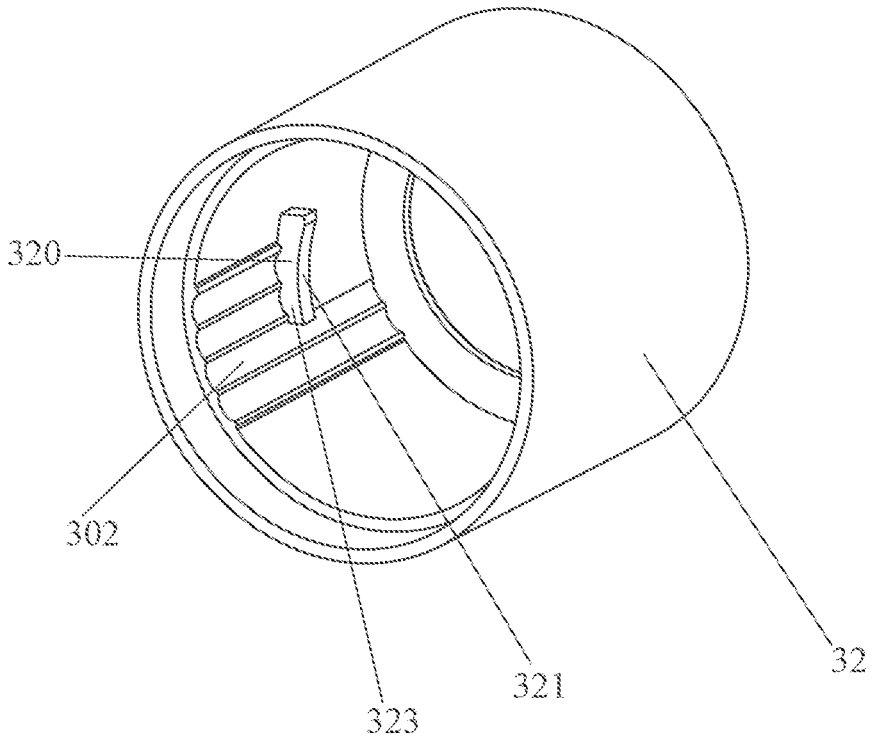
FIG. 9 is a perspective view of a rotating sleeve.

As shown in FIGS. 5 and 9, the rotating sleeve 32 is rotatably sleeved on the connection end 30. An inner wall of the rotating sleeve 32 is provided with a driving part 320, and the rotating sleeve 32 rotates to drive the driving part 320 to further drive the locking member 31 to rotate, so that the locking portion 312 is locked or unlocked from the locking fitting portion 20.

Figure 8:
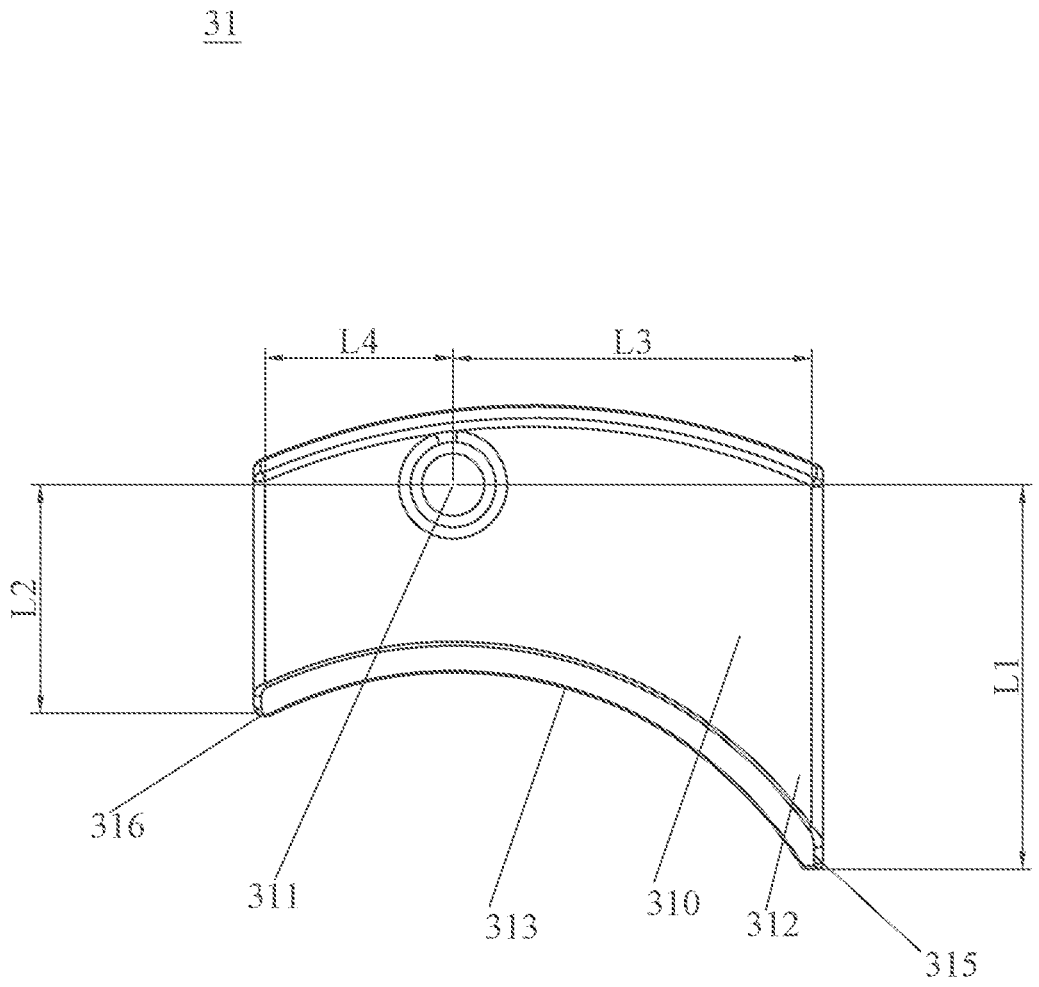
FIG. 8 is a front view of the locking member shown in FIG. 6.

Through the above-mentioned connecting-fixing structure, the power cord 2 can be disassembled and assembled only by rotating the rotating sleeve 32 in a forward or reverse rotation, which is convenient and safe, has a simple structure, reduces many power lines and avoids line entanglement. More specifically, as shown in FIG. 7, a bottom surface 313 of the locking piece 310 is an arc-shaped surface, and the bottom surface 313 is aligned with an outer wall of the power cord 2. In this way, when the locking portion 312 on the locking member 31 is locked with the locking fitting portion 20 on the power cord 2, the arc-shaped bottom surface 313 is attached to the outer wall of the power cord 2 to fix the power cord 2. Preferably, as shown in FIGS. 6-8, the bottom surface 313 includes a first end 315 and a second end 316. The longitudinal distance L1 between the first end 315 and the supporting shaft 311 is greater than the longitudinal distance L2 between the second end 316 and the supporting shaft 311. The locking portion 312 is disposed at the first end 315, and the locking fitting portion 20 is an engaging groove capable of engaging with the locking portion 312. In this embodiment, when the power cord 2 needs to be fixed, the rotating sleeve 32 is rotated to drive the locking member 31 to rotate, so that the locking portion 312 is inserted into the engaging groove on the power cord 2 to lock the locking member 31 and the power cord 2 together. When the power cord 2 needs to be unlocked, the rotating sleeve 32 is rotated in the reverse direction, and the locking member 31 is driven to reverse, so that the locking portion 312 on the locking member 31 is separated from the engaging groove on the power cord 2 to unlock the power cord 2.

As shown in FIG. 8, in order to ensure the sensitive operation of the locking member 31 and enhance simultaneously the contact area between the bottom surface 313 of the locking piece 310 and the power cord 2, the horizontal distance L3 between the supporting shaft 311 and the first end 315 is greater than the horizontal distance L4 between the supporting shaft 311 and the second end 316. That is, the supporting shaft 311 is eccentrically arranged, so that the locking member 31 rotates a small angle towards the locking portion 312 to lock the power cord 2. Moreover, when the locking portion 312 is engaged with the engaging groove, the bottom surface 313 of the locking piece 310 has a larger contact area with the power cord 2.

As a further improvement, as shown in FIGS. 6 and 9, a top surface 314 of the locking piece 310 is an arc-shaped surface. The driving part 320 is a protrusion protruding toward the inside of the rotating sleeve 32. A pressing surface 321 matching the top surface 314 of the locking piece 310 is provided on the side of the driving part 320 away from an inner wall of the rotating sleeve 32. In this embodiment, the contact surface between the locking piece 310 and the driving part 320 is an arc-shaped surface that matches each other. Thus, when the user rotates the rotating sleeve 32, the rotation is smoother, and the locking member 31 is more sensitive. Preferably, the distance between tone end of the pressing surface 321 facing to the first end 315 and the inner wall of the rotating sleeve 32 is greater than the distance between the other end of the pressing surface 321 and the inner wall of the rotating sleeve 32. That is to say, the overall structure of the driving part 320 is substantially the same as the overall contour structure of the locking piece 310.

As a further improvement, as shown in FIGS. 3 and 9, in order to facilitate the rotation of the rotating sleeve 32 and fixing the rotating sleeve 32 at a certain rotating position, one of the outer wall of the connection end 30 and the inner wall of the rotating sleeve 32 is provided with several sliding grooves 302, and the other of the outer wall of the connection end 30 and the inner wall of the rotating sleeve 32 is provided with a clamping portion 322 corresponding to the sliding grooves 302. Specifically, the clamping portion 322 can be rotated step by step along the sliding grooves 302. In this embodiment, as shown in the FIGS. 3 and 9, the sliding grooves 302 are provided on the inner wall of the rotating sleeve 32, and the clamping portion 322 is provided on the outer wall of the connection end 30. When the rotating sleeve 32 is rotated, the clamping portion 322 can be rotated step by step along the sliding grooves 302 under the action of the rotation force. When the rotating sleeve 32 is rotated to lock and unlock the power cord 2, the user overcomes the sliding friction between the clamping portion 322 and the sliding grooves 302, so that the clamping portion 322 continuously slides on the sliding grooves 302.

In addition, in order to limit the rotation space of the rotating sleeve 32, a limiting plate 303 for blocking the driving part 320 is respectively disposed on the outer wall of the connection end 30 at both ends of the accommodating groove 301. Thus, the rotation space of the rotating sleeve 32 is defined by the driving part 320 on the rotating sleeve 32 and the two limiting plates 303. Thus, when the rotating sleeve 32 rotates to a limit position in one direction, the driving part 320 on the rotating sleeve 32 abuts against one of the limiting plates 303 on the corresponding end of the accommodating groove 301 to prevent the rotating sleeve 32 from further rotating. When the rotating sleeve 32 reverses to the other direction to another limit position, the driving part 320 on the rotating sleeve 32 abuts against the other limiting plate 303 on the other end of the accommodating groove 301 to prevent the rotating sleeve 32 from further rotating.

Furthermore, please refer to FIG. 5 again, as a further improvement, two locking members 31 are oppositely provided on the connection end 30, and two driving parts 320 respectively adapted to the two locking members 31 are provided on the rotating sleeve 32.

Therefore, as shown in FIGS. 1 to 9, the hair treatment appliance disclosed in the present invention is provided with the connecting-fixing structure which includes the locking member 31 and the rotating sleeve 32. The locking member 31 is mounted on the outer wall of the connection end 30 on the end of the hair treatment appliance, and the power cord 2 is provided with an engaging groove that matches the locking portion 312 on the locking member 31. When the user assembles the power cord 2, firstly, the power cord 2 is inserted through the cavity 300 of the connection end 30 and connected to the connection end 30 in the hair treatment appliance. Then, the rotating sleeve 32 is rotated to drive the two locking members 31 to rotate, so that the locking portions 312 on the two locking members 31 are engaged with the engaging grooves on the power cord 2 to lock the power cord 2. When the power cord 2 needs to be removed, the rotating sleeve 32 is rotated in the opposite direction, so that the two locking members 31 rotate in the opposite direction, so that the locking portions 312 on the locking members 31 are separated from the engaging grooves on the power cord 2, thereby unlocking the power cord 2.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A connecting-fixing structure, adapted for detachably connecting a main body of an electrical appliance with a power cord, the connecting-fixing structure comprising:

a connection end, arranged at a tail end of the main body and having a cylindrical structure, and a tail end of the power cord passing through a cavity of the connection end and further plugging into the connection end;

a locking member, comprising a locking piece which is provided with a supporting shaft and a locking portion on one side of the supporting shaft, the locking portion being capable of rotating by the supporting shaft as a fulcrum, and a locking fitting portion being disposed on the tail end of the power cord and adapted to the locking portion; and an outer wall of the connection end being opened with an accommodating groove that is communicated with the cavity of the connection end and fits the locking member, and the locking member being mounted in the accommodating groove and pivotally connected to a side wall of the accommodating groove through the supporting shaft; and a rotating sleeve, rotatably sleeved on the connection end, an inner wall of the rotating sleeve being provided with a driving part, and the rotating sleeve being rotated to drive the driving part to further drive the locking member to rotate, thereby locking the locking portion or unlocking the locking portion from the locking fitting portion.

2. The connecting-fixing structure according to claim 1, wherein a bottom surface of the locking piece is an arc-shaped surface, and the curvature of the bottom surface fits an outer wall of the power cord.

3. The connecting-fixing structure according to claim 2, wherein the bottom surface of the locking piece comprises a first end and a second end, the longitudinal distance between the first end and the supporting shaft is greater than the longitudinal distance between the second end and the supporting shaft, the locking portion is disposed at the first end, and the locking fitting portion is an engaging groove capable of engaging with the locking portion.

4. The connecting-fixing structure according to claim 3, wherein the horizontal distance between the supporting shaft and the first end is greater than the horizontal distance between the supporting shaft and the second end.

5. The connecting-fixing structure according to claim 3, wherein a top surface of the locking piece is an arc-shaped surface, the driving part is a protrusion protruding toward the inside of the rotating sleeve, and a pressing surface matching the top surface of the locking piece is provided on a side of the driving part away from the inner wall of the rotating sleeve.

6. The connecting-fixing structure according to claim 5, wherein the distance between one end of the pressing surface facing to the first end and the inner wall of the rotating sleeve is greater than the distance between the other end of the pressing surface and the inner wall of the rotating sleeve.

7. The connecting-fixing structure according to claim 1, wherein one of the outer wall of the connection end and the inner wall of the rotating sleeve is provided with several sliding grooves, the other of the outer wall of the connection end and the inner wall of the rotating sleeve is provided with a clamping portion corresponding to the sliding grooves, and the clamping portion is rotated along the sliding grooves.

8. The connecting-fixing structure according to claim 1, wherein a limiting plate for blocking the driving part is respectively disposed on the outer wall of the connection end at both ends of the accommodating groove.

9. The connecting-fixing structure according to claim 1, wherein two locking members are oppositely provided on the connection end, and two driving parts respectively corresponding to the two locking members are provided on the rotating sleeve.

10. A hair treatment appliance, comprising a main body and a power cord, the main body being provided with a connection end for plugging-in the power cord, wherein the power cord is detachably connected with the main body through a connecting-fixing structure according to claim 1.

* * * * *